United States Patent [19]

Nasson

[11] 4,094,529

[45] June 13, 1978

[54] SKI BINDING ADAPTER

[76] Inventor: Harold H. Nasson, 8 Hidden Ledge Rd., Manchester, Mass. 01944

[21] Appl. No.: 785,519

[22] Filed: Apr. 7, 1977

[51] Int. Cl.[2] ..... A63C 9/086

[52] U.S. Cl. ..... 280/614

[58] Field of Search ..... 280/611, 614, 616, 617, 280/618

[56] References Cited

U.S. PATENT DOCUMENTS

| | | | |
|---|---|---|---|
| 2,758,846 | 8/1956 | Swensen | 280/614 |
| 3,908,971 | 9/1975 | Engel | 280/614 |
| 4,002,354 | 1/1977 | Ramer | 280/614 |

FOREIGN PATENT DOCUMENTS

| | | | |
|---|---|---|---|
| 2,275,231 | 6/1974 | France | 280/614 |

*Primary Examiner*—Joseph F. Peters, Jr.
*Assistant Examiner*—Gene A. Church
*Attorney, Agent, or Firm*—Cesari and McKenna

[57] ABSTRACT

An adapter that retains the toe of a conventional cross-country ski boot can be clamped in a conventional downhill ski binding so that the user can use the same skis for both types of skiing.

12 Claims, 2 Drawing Figures

SKI BINDING ADAPTER

BACKGROUND OF THE INVENTION

This invention relates to a ski binding. It relates more particularly to an adapter that permits a skier's boots to be clamped to the same ski in the two different ways required for downhill and cross-country skiing.

When skiing downhill, both toe and heel of the skier's boot should be clamped to the ski so that there is essentially no relative movement between the wearer's foot and the ski. To achieve this result, the usual downhill ski boot has a relatively thick sole that is quite rigid. The boot is secured to the ski by a binding that includes a clamp device that engages over the protruding front edge of the shoe sole and a second clamp or spring that engages the heel of the ski boot. Thus the boot is retained to the ski both at its front and rear ends. In some cases, these clamps release automatically when subjected to an unusually high torque or lateral thrust that occurs when the skier falls the wrong way. This enables the boot to separate from the ski minimizing the chances of injury to the skier.

In cross-country skiing, which involves climbing and traversing, as well as some downhill skiing, it is desirable for the skier to be able to flex his foot up and down on the ski to achieve optimum control during the different situations encountered in cross-country skiing. To this end, the cross-country ski boots usually have relatively flexible soles. The boot is secured to the ski by a binding that engages around the protruding side and forward edge margin or welt of the boot sole. Relative sliding movement between the boot and ski is prevented by one or more pegs which project up from the top of the ski into mating openings in the underside of the boot sole.

Normally a given ski has either a cross-country binding or a downhill binding permanently attached to the ski. Therefore as a practical matter that ski is dedicated to either downhill or cross-country skiing because a cross-country binding cannot retain the heel of a ski boot and the downhill binding which normally retains the heel of the boot does not have any means for preventing sliding between the boot and ski should the boot heel retainer be omitted.

There do exist some special binding mechanisms for permanent attachment to skiis which can be adjusted by a skier while standing on the skiis so that, in one position, the heel of the boot is secured and in a second position, the heel of the boot is free. Such bindings are shown, for example, in U.S. Pat. Nos. 2,831,696 and 3,951,424. However these devices are relatively complex and therefore expensive. Also in some cases, they make no provision for releasing the skier's boot in the event of a fall. Additionally, since the skier must typically change his boots when switching from downhill to cross-country skiing, the fact that such mechanisms can be adjusted by the skier while standing on the skiis represents no real advantage.

SUMMARY OF THE INVENTION

Accordingly the present invention aims to provide an adapter for retaining the toe of a cross-country ski boot that can be clamped in a conventional downhill ski binding to permit the same ski to accommodate both types of ski boots.

A further object of this invention is to provide an adapter of this type which is relatively simple and inexpensive to manufacture.

A further object of the invention is to provide an adapter that adapts a downhill ski binding to a cross-country boot which does not interfere with the safety release mechanism of the downhill binding.

Still another object is to provide an adapter of this type which is simple yet rugged and reliable so that it should have a long useful life.

Another object is to provide an adapter of this type which is relatively compact and lightweight so it can be carried easily by the skier.

Other objects will, in part, be obvious and will, in part, appear hereinafter.

The invention accordingly comprises the features of construction, combination of elements and arrangement of parts as exemplified in the following detailed description, and the scope of the invention will be indicated in the claims.

Briefly, my adapter which retains a standard cross-country ski boot can be clamped in the standard downhill ski binding so that the same ski can be used for both types of skiing. The adapter comprises a front or toe section and a rear or heel section which are adjustably connected so that the overall length of the adapter can be varied to fit between the front and rear clamps of a given downhill ski binding.

In an illustrative embodiment, the front end of the toe section includes a block having more or less the same dimensions as the forwardly projecting sole portion of a typical downhill ski boot. This block is arranged to be engaged by the forward clamp of the downhill ski binding in the same way as the toe of the boot is normally retained.

A second block shaped more or less like the rearwardly projecting heel portion of a standard downhill ski boot is positioned at the rear end of the heel section. This block is adapted to be engaged by the rear clamp of the standard downhill ski binding in exactly the same way as the binding would normally clamp a downhill ski boot. Thus both the front and rear ends of the adapter are securely anchored to the ski.

Projecting up from the toe section rearwardly of the block thereon is one or more upstanding locating pegs which are arranged to engage in the usual openings found in the underside of the standard cross-country ski boot sole.

The toe section also includes a clamp for securing the cross-country boot to that section when the pegs are received in the sole openings. Preferably the clamp comprises a pair of spaced-apart, parallel retainer plates with side walls that conform to and engage the opposite sides of the boot sole. These plates are pivotally mounted to the toe section so that the spacing between them can be varied to accommodate a particular width ski boot. A generally U-shaped bail is pivotally connected between the outer edges of the two plates so that the bail can be swung up to a generally vertical position allowing the ski boot to be positioned on the adapter toe section with its sole receiving the locating pegs. With the boot properly seated, the bail is swung down to a generally horizontal clamping position in which it engages over the projecting welt at the sides and front of the boot. A lock is provided at the front of the toe section for retaining the bail in its horizontal clamping position. Thus the skier's boot is clamped to the adapter only at the toe and he is able to flex his foot up and down on the ski just as he can on a standard cross-country ski.

Since the present adapter can be adjusted in length so that it fits in any standard downhill ski binding and can be adjusted to suit the width of a particular skier's ski boot, a single standard adapter can be used by all skiers to convert their downhill skiis to cross-country skiis. Furthermore, the conversion is accomplished without requiring any special tools, fittings or other equipment. Moreover, the adapters are small enough so that the skier can carry them and his cross-country boots with him when he is skiing downhill, and then change his boots and easily add the adapters to his downhill skiis when he wishes to travel cross-country.

The adapter consists of only a relatively few parts which are for the most part simple metal stampings. Therefore, it can be manufactured quite easily at relatively low cost. Yet it is rugged and reliable and does not interfere with the operation of the releasing mechanism of the downhill binding should the cross-country skier suffer an accident. In that event, the adapter releases from the ski in the same way as does the downhill ski boot.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 1:
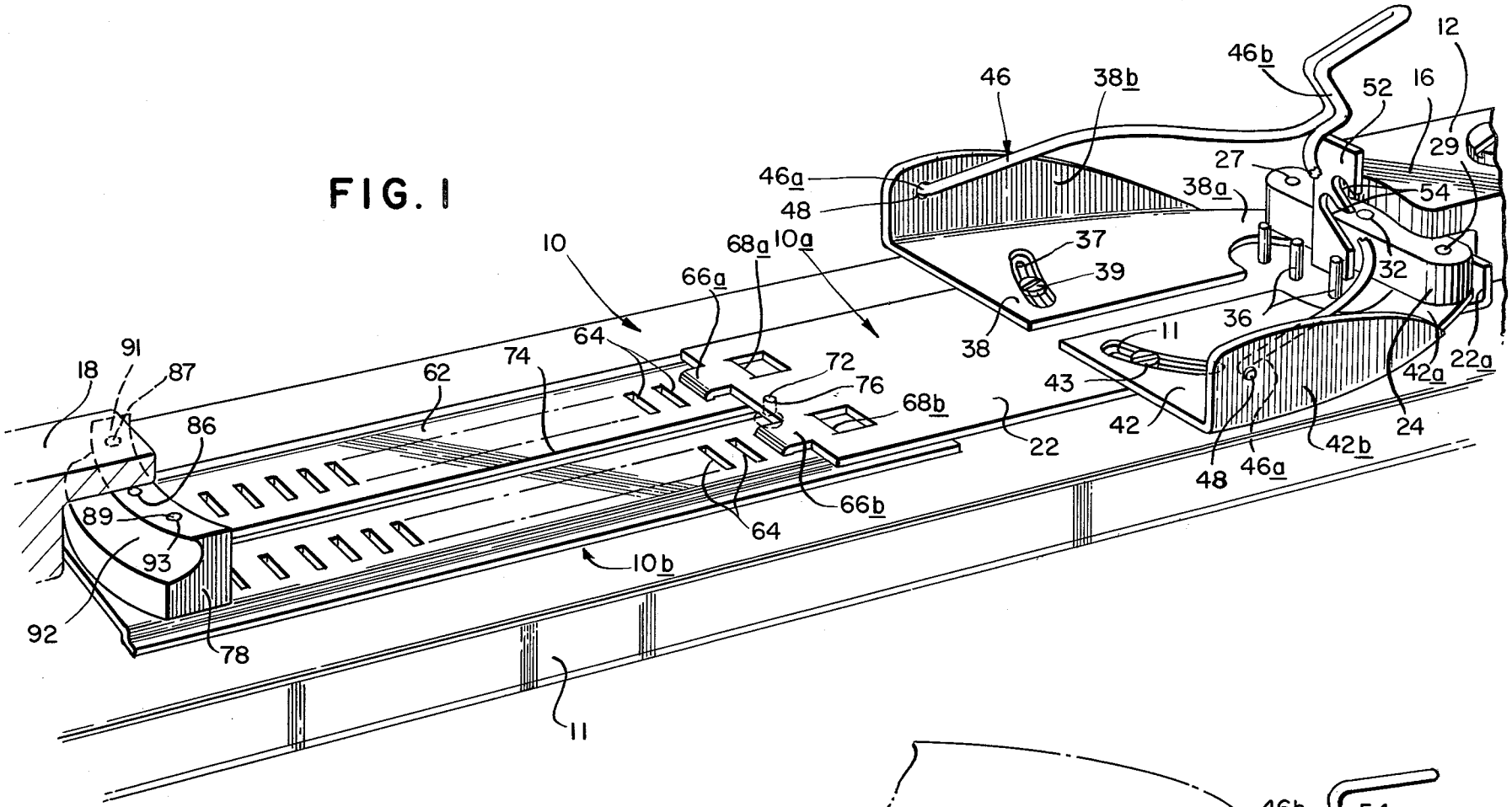
FIG. 1 is a perspective view of a ski binding adapter embodying the principals of the invention.

Referring now to the drawing, my adapter shown generally at 10 is arranged to be removably clamped to a ski 11 by a conventional downhill ski binding 12 permanently secured to the ski. The adapter comprises a front or toe section 10*a* and a rear or heel section 10*b* which are adjustable lengthwise relative to one another to permit the adapter to be clamped between variously spaced-apart front and rear clamps 16 and 18 of the usual binding 12.

The binding 12 and front and rear clamps 16 and 18 specifically are standard items and do not form part of this invention. Suffice it to say that they are arranged and adapted to normally engage over the front edge of the sole that projects beyond the toe and the heel of the usual downhill ski boot to rigidly anchor the toe and heel of the boot to the ski.

Adapter section 10*a* includes a generally rectangular plate 22 having an upstanding lip 22*a* at its front end. Positioned adjacent lip 22*a* is a generally rectangular block 24 that extends the full width of plate 22. The block is anchored to the plate by means of a bolt 26 extending through opening 28 in the plate and screwed into threaded passage 32 in the block. The lip 22*a* prevents rotation of the block 24. When the adapter is positioned in the binding 12, the front clamp 16 of the binding engages over the block 24 and clamps it relative to the ski. The bolt 26 is rotatably secured to the plate 22 by a snap ring 34. The bolt 26 can thus be turned in either direction of the plate to adjust the height of the block 24 above the plate 22 to assure that the block is securely clamped by clamp 16.

One or more pins or pegs 36 project up from plate 22 just rearwardly of block 24. These pegs are arranged and adapted to engage in the usual openings formed in the underside of the sole of a conventional cross-country ski boot. The size and spacing of these pegs are more or less standard in the industry.

A pair of mirror image retainer plates 38 and 42 are positioned on plate 22 and extend rearwardly of block 24. Plate 38 has a necked-down portion 38*a* extending around one side of the set of pegs 36 and between plate 22 and block 24 where it is pivotally retained by a rivet 27. Also, the outer edge of plate 38 is provided with an upstanding wall 38*b* extending from the rear edge of the plate to the necked-down portion 38*a*. Plate 42 is similar to plate 38 in that it has a necked-down portion 42*a* that extends around the other side of the peg set and between plate 22 and block 24 and is pivotally retained by a rivet 29. Also the outer edge of plate 42 is formed with an upstanding wall 42*b*.

The adapter section 10*a* also includes a generally U-shaped wire bail 46. The opposite ends 46*a* of the bail are turned outwardly and project through openings 48 provided at the rear ends of plate walls 38*b* and 42*b*. Thus the bail 46 can be swung about its two pivot points at 48. The ends of the bail are flattened to retain them in the openings and a forwardly protruding upwardly offset handle 46*b* is formed at the middle of the bail to facilitate moving the bail.

Figure 2:
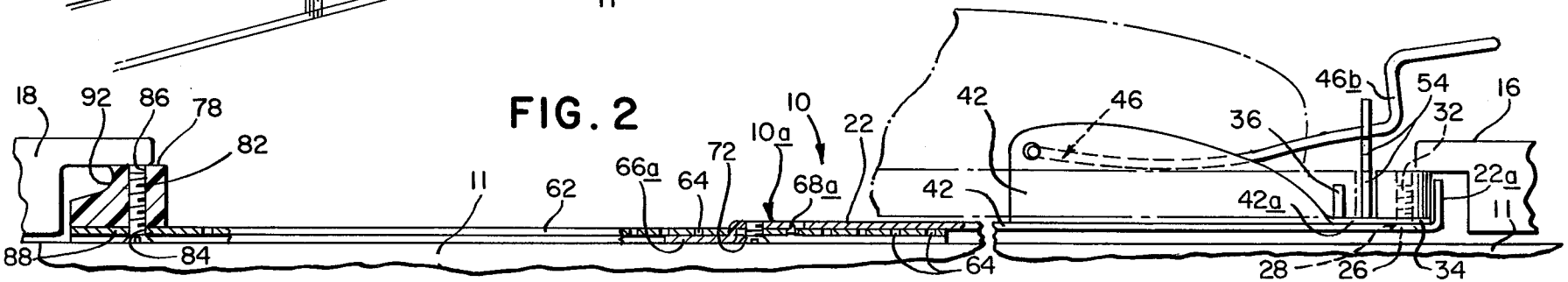
FIG. 2 is a longitudinal section of the adapter of FIG. 1, but showing the adapter in its locked position.

The bail 46 is swingable between a generally upstanding position shown in FIG. 1 to permit a cross-country ski boot to be positioned on the front section 10*a* with the pegs 36 received in the openings in the shoe sole. The bail can also be swung down to a generally horizontal position illustrated in FIG. 2 wherein the sides of the bail engage over the welt normally projecting out at the sides and front of the ski boot as shown in dotted lines in FIG. 2. In this position, the bail securely anchors the toe of the boot to the adapter section 10*a*. The bail is locked in this position by an upstanding retainer 52 anchored to plate 22. The retainer 52 is provided with a set of vertically spaced, upwardly angled slots 54 and the bail handle 46*b* is engaged in one or another of these slots so that the boot toe remains tightly clamped between the bail and plates 38 and 42. Most preferably, the sides of the bail should be bowed downwardly somewhat as best seen in FIG. 2 so that when the bail is locked, it actually presses down against the boot welt.

The plates 38 and 42 can be swung toward and away from one another to some extent about their pivots at the rivets 27 and 29 so that the spacing between them can be adjusted to accommodate different width ski boots. The plates should be adjusted so that their walls 38*b* and 42*b* engage the opposite side edges of the boot sole. The bail 46 is sufficiently flexible to accommodate this movement. Most preferably, the bail is shaped so that it functions like a spring tending to bias plates 38 and 42 toward one another. Also when the bail is in its locked position shown in FIG. 2, the plates 38 and 42 are clamped between the boot and plate 22 further reducing their tendancy to spread apart. For this reason, the facing surfaces for the plate 22 and the plates 38 and 42 may be dimpled or roughened to increase the friction therebetween. if desired, means such as slots 37 and 41 in plates 38 and 42, respectively, and tightening screws 39 and 43, may be included for clamping the plates 38 and 42 relative to the plate 22 after the proper width has been determined.

The converter section 10b comprises a generally rectangular plate 62 which is lengthwise adjustably secured to plate 22. More particularly, plate 62 includes two columns of slots 64 spaced-apart along its length. The slots are arranged to receive a first pair of spaced-apart, vertically off-set tabs 66a and 66b projecting from the rear edge of plate 22 as well as a second pair of depending tabs 68a and 68b struck from plate 22 forwardly of tabs 66a, 66b. These tabs are arranged so that when the tabs 66a and 66b are seated in one pair of slots 64, the other pair of tabs 68a and 68b project down through a second pair of slots 64 as shown in FIG. 2. The two plates 22 and 62 can be retained in a selected position of adjustment by means of a set screw 72 or other suitable fastener that extends through a lengthwise slot 74 in plate 62 and is screwed down into a threaded passage 76 in plate 22.

Projecting up from the rear end of plate 62 is a block 78 which is shaped more or less like the rear portion of a standard downhill ski boot heel. Block 78 is secured to plate 62 by a bolt 82 extending through a center passage 84 in plate 62 and screwed into threaded passage 86 in block 78. The block 78 is clamped by the standard downhill ski binding rear clamp 18 thereby securely retaining the rear end of the adapter to the ski. As with the front toe block 24, the bolt 82 is rotatably secured to the plate 62 by a snap ring 88 so that the bolt 82 can be turned to adjust the height of the block 78 to assure that it is firmly gripped by clamp 18. Upwardly directed guide pins 87 and 89 are fixed to the plate 62 and located within passages 91 and 93 on each side of the passage 86 to prevent the block 78 from rotating.

Also the rear face of the block 78 can be provided with a groove 92 similar to the groove usually found at the rear of some ski boot heels so that the present adapter can also be used with downhill binding of the type that relies on a spring engaging around the boot heel to clamp the heel to the ski.

To install the adapter on a standard downhill ski, the user simply inserts it between the front and rear clamps 16 and 18 of the ski binding. Of course, the length of the converter is adjusted as required to place the blocks 24 and 78 directly underneath the clamps 16 and 18 respectively. Then with bail 46 in its raised position shown in FIG. 1, the boot is placed in the adapter with the pegs 36 being received in the sole openings in the boot. Plates 38 and 42 are then pressed together so that their walls 38b and 42b engage the sides of the shoe sole. Finally, the bail 46 is swung down to its clamping position illustrated in FIG. 2 with its handle 46b engaging in a slot 54 in fixture 52.

With this arrangement the skier can quickly convert any standard downhill ski binding that normally clamps both the boot toe and the heel to the ski to one capable of accommodating a cross-country ski boot that is normally clamped only at the toe. The adapter is constructed for the most part of inexpensive stamped metal and wire parts so that it is relatively inexpensive to make. Yet it is relatively rugged so that it should have a long useful life.

Furthermore, the installation of the present adapter on a standard ski does not interfere with the quick release mechanisms customarily incorporated into standard downhill ski bindings. Therefore a skier is also protected in the event of an accident when skiing cross-country.

It should be noted that the blocks 24 and 78 could be also formed integral with the plates 22 and 62 by bending the respective end sections of the plates into the shape of a block.

It will thus be seen that the objects set forth above, among those made apparent from the preceding description are efficiently attained, and since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

I claim:

1. An adapter for use in conjunction with a standard downhill ski having a standard downhill ski binding including toe and heel clamps secured thereto, said adapter being removably retainable in the standard downhill ski binding and being adapted to clamp a cross-country ski boot so as to enable the standard downhill ski to be used for cross-country skiing, said adapter comprising A. first and second elongated relatively thin adapter plate sections adapted to be supported on the downhill ski between the toe and heel clamps of the standard downhill binding, said plate sections being adjustable lengthwise relative to one another, B. means for securing said plate sections in different selected positions of lengthwise adjustment, C. means projecting upwardly from the forward end of said first plate section adapted to be clamped to the downhill ski by the toe clamp of the standard downhill binding, D. means projecting upwardly from the rear end of said second plate section adapted to be clamped to the downhill ski by the heel clamp of the standard downhill binding, E. clamp means mounted on said first adapter plate section, said clamp means being movable from an open position wherein it permits the cross-country ski boot to be positioned on said first adapter plate section to a closed position wherein it clamps the toe of the cross-country ski boot to said first adapter plate section, and F. means mounted on said first adapter plate section for locking said clamp means in its closed position.

2. The adapter defined in claim 1 wherein said means for securing the two adapter sections includes A. one or more tabs on one of said sections, B. a plurality of slots spaced along the other of said sections, said tabs being engaged in selected ones of said slots when said sections are in said different selected positions of lengthwise adjustment.

3. The adapter defined in claim 1 further including

A. one or more upstanding locating pegs mounted on said first adapter plate section, said pegs being arranged and adapted to be receiving in corresponding sole openings in the cross-country ski boot.

4. The adapter defined in claim 3 wherein said clamp means comprises a generally U-shaped bail pivotally mounted at its ends to said first adapter plate section rearwardly of said pegs, said bail being adapted to engage over the welt of the cross-country ski boot positioned in said first adapter plate section.

5. The adapter defined in claim 4 wherein said locking means comprises a retainer positioned adjacent the bail, said retainer being adapted to engage a portion of the bail when the bail is in its closed position.

6. The adapter defined in claim 4 wherein the sides of said bail are bowed so that they press down on opposite sides of the welt of the cross-country ski boot positioned on the first adapter section when the bail is in its closed position.

7. The adapter defined in claim 4 wherein said first adapter plate section also includes A. a pair of retainer plates having portions thereof adapted to engage the sides of the sole of the cross-country ski boot positioned on said first adapter plate section, B. means for pivotally mounting said plates so that they can be selectively spaced apart from one another to accommodate different width boot soles on said first adapter plate section, and C. wherein the ends of said bail are pivotally mounted to said retainer plates.

8. The adapter defined in claim 7 wherein said bail is arranged and adapted to bias said retainer plates toward one another.

9. The adapter defined in claim 1 wherein said upwardly projecting forward end means comprises a block shaped substantially like the forwardly projecting sole portion of a standard downhill ski boot.

10. The adapter defined in claim 1 wherein said upwardly projecting rear end means comprises a block shaped substantially like the rearwardly projecting heel portion of a standard downhill ski boot.

11. The adapter defined in claim 9 and further including means for adjusting the height of said upwardly projecting forward end means above said first adapter section.

12. The adapter defined in claim 10 and further including means for adjusting the height of said upwardly projecting rear end means above said second adapter section.

* * * * *